US005858056A

United States Patent [19]

Fujine et al.

[11] Patent Number: 5,858,056

[45] Date of Patent: Jan. 12, 1999

[54] METAL SINTERED BODY COMPOSITE MATERIAL AND A METHOD FOR PRODUCING THE SAME

[75] Inventors: Manabu Fujine, Toyota; Yoshiaki Kajikawa, Aichi-ken; Minoru Yamashita, Okazaki; Koji Saito, Toyota, all of Japan

[73] Assignee: Toyota Jidosha Kabushiki Kaisha, Japan

[21] Appl. No.: 616,741

[22] Filed: Mar. 15, 1996

[30] Foreign Application Priority Data

Mar. 17, 1995 [JP] Japan ..... 7-059455
Mar. 13, 1996 [JP] Japan ..... 8-056518

[51] Int. Cl.[6] ..... B22F 3/12

[52] U.S. Cl. ..... 75/236; 75/246; 419/14; 419/25; 419/27; 419/53; 419/54; 419/55

[58] Field of Search ..... 419/27, 53, 54, 419/55, 25, 14; 75/236, 246

[56] References Cited

U.S. PATENT DOCUMENTS

| | | | |
|---|---|---|---|
| 2,456,779 | 12/1948 | Goetzel | 75/22 |
| 2,633,628 | 4/1953 | Bartlett | 29/156.8 |
| 3,973,061 | 8/1976 | Easwaran et al. | 427/319 |
| 4,327,156 | 4/1982 | Dillon et al. | 428/568 |
| 4,334,507 | 6/1982 | Kohnert et al. | 123/193 |
| 4,505,988 | 3/1985 | Urano et al. | 428/569 |
| 4,606,768 | 8/1986 | Suilar et al. | 75/246 |
| 4,734,968 | 4/1988 | Kuroishi et al. | 29/156.7 A |
| 4,769,071 | 9/1988 | Klar et al. | 75/246 |
| 4,861,373 | 8/1989 | Klar et al. | 75/244 |
| 4,971,755 | 11/1990 | Kawano et al. | 419/10 |
| 4,976,778 | 12/1990 | Berry et al. | 75/254 |

FOREIGN PATENT DOCUMENTS

| | | |
|---|---|---|
| 0 480 495 A3 | 4/1992 | European Pat. Off. . |
| 0 497 714 A1 | 8/1992 | European Pat. Off. . |
| 1758286 | 1/1971 | Germany . |
| 63-312947 | 12/1988 | Japan . |
| 2-108446 | 4/1990 | Japan . |
| 3-189063 | 8/1991 | Japan . |
| 3-189064 | 8/1991 | Japan . |
| 3-189066 | 8/1991 | Japan . |

OTHER PUBLICATIONS

Patent Abstracts of Japan, vol. 015, No. 443 (M–1178), Nov. 12, 1991.

Chemical Abstracts, vol. 116, No. 12, Mar. 23, 1992, Columbus, Ohio, US; abstract No. 111027, Murase, Hiroyuki et al; "Wear–resistant sintered alloys for valve seats", XP002007213.

European Search Report dated Jul. 3, 1996 (2 pages) Communication dated Jul. 12, 1996 (1 page).

*Primary Examiner*—Daniel J. Jenkins

*Attorney, Agent, or Firm*—Finnegan, Henderson, Farabow, Garrett & Dunner, L.L.P.

[57] ABSTRACT

A metal sintered body composite material which can exhibit superior seizure resistance even when light metal is softened, and a method for producing the same. The production method uses iron base raw material powder including C and one of Cr, Mo, V, W, Mn, and Si, and comprises the steps of forming and sintering a powder compressed article so as to obtain a porous metal sintered body having a space lattice structure having pores, impregnating the pores of the porous metal sintered body with an aluminum alloy and solidifying the aluminum alloy, applying aging treatment by heating and holding the composite material at an aging treatment temperature range, whereby a metal constituting the porous metal sintered body has a micro-Vickers hardness of 200 to 800.

26 Claims, 8 Drawing Sheets

TEST SPECIMEN C 50μm

TEST SPECIMEN C 20μm

TEST SPECIMEN C 100μm
PASSED SEIZURE TEST

TEST SPECIMEN B 100μm
FAILED SEIZURE TEST

METAL SINTERED BODY COMPOSITE MATERIAL AND A METHOD FOR PRODUCING THE SAME

BACKGROUND OF THE INVENTION

1. Field of the Invention

This invention relates to a metal sintered body composite material impregnated with a light metal and having improved seizure resistance, and a method for producing the same.

2. Description of the Related Art

In the case of using light metals such as aluminum alloys, and magnesium alloys, it is general to use metal matrix composite materials including reinforcing members such as ceramic fibers, ceramic particles, and intermetallic compound particles. However, when these materials are used at elevated environmental temperatures, for example, when these materials are used as members sliding at temperatures over 200° C., the above conventional metal matrix composite materials cannot prevent seizure effectively. Although a larger amount of reinforcing members can be added to the above composite materials, this causes a considerable increase in production costs and a remarkable decrease in machinability.

As an effective means for solving these problems, composite materials have been proposed which are prepared by using a porous iron base metal sintered body, impregnating the porous iron base metal sintered body with a light metal, and solidifying the light metal, as disclosed by Japanese Unexamined Patent Publication (KOKAI) Nos. 63-312947, 3-189063, and 3-189066.

More specifically, Japanese Unexamined Patent Publication (KOKAI) No. 63-312947 discloses a composite material which is prepared by employing a porous body formed of a Cu-C-Mo-Fe alloy (an equivalent of SAE86) and having interconnecting pores at a porosity of 10 to 90%, impregnating the pores of the porous body with a molten light metal, and solidifying the molten light metal.

Japanese Unexamined Patent Publication (KOKAI) No.3-189063 discloses a composite material which is prepared by employing a porous iron base metal having pore surface covered with iron sesquioxide, triiron tetroxide, ferrous hydroxide and so on, impregnating pores of the porous iron base metal with a molten light metal, and solidifying the molten light metal. This composite material is expected to prevent local cells from generating at the boundary.

Japanese Unexamined Patent Publication (KOKAI) No.3-189066 discloses a composite material which is prepared by using a porous iron base metal sintered body including at least one element of nickel (Ni), cobalt (Co), chromium (Cr), molybdenum (Mo), manganese (Mn) and tungsten (W), impregnating this porous metal sintered body with a molten aluminum alloy under a pressure of 400 to 1000 kg/cm$^2$, and solidifying the molten aluminum alloy. This publication also discloses techniques of improving corrosion resistance and heat resistance by applying electroless plating or electrolytic plating to inner surfaces of the porous metal sintered body.

Simple impregnation of the porous metal sintered body with a light metal, however, cannot attain a sufficient seizure resistance in a high temperature range. This is because the impregnated light metal plastically flows under severe sliding conditions.

This invention has been conceived in view of the above circumstances. It is an object of the present invention to provide a metal sintered body composite material having a sufficient seizure resistance in sliding by setting the micro-Vickers hardness of a metal constituting the porous iron base metal sintered body at 200 to 800.

It is a further object of the present invention to provide a method of producing a metal sintered body composite material having a superior seizure resistance in sliding.

When used in a high temperature range over 200° C., the conventional metal sintered body composite materials in which ceramic fibers or intermetallic compounds are dispersed exhibit a remarkable decrease in the hardness of a light metal and accordingly cause seizure. The present inventors have found that by enabling a metal constituting the porous metal sintered body to have a micro-Vickers hardness in the range from 200 to 800, the porous metal sintered body can easily secure a space lattice structure even at high environmental temperatures, can hold the light metal tightly, and can attain improved seizure resistance even when the light metal is softened. The present inventors have also found that by stopping employing liquid quenching which often develops gas defects because of quenching liquid remaining in pores of a porous metal sintered body, and by enabling the porous metal sintered body to be gas quenched by use of an alloying element having a high quench-multiplying factor, the micro-Vickers hardness of a metal constituting a porous iron base metal sintered body can be set at 200 to 800 owing to a hardening effect of a quenched phase attained by gas quenching and a hardening effect of carbide generation after quenched. The present inventors have completed the metal sintered body composite material of the present invention based on the above findings.

SUMMARY OF THE INVENTION

The metal sintered body composite material according to the present invention comprises:

- a porous iron base metal sintered body having a space lattice structure having pores; and
- a light metal which the pores of the porous metal sintered body have been impregnated with and which has been solidified,
- the micro-Vickers hardness of a metal constituting the porous metal sintered body being set at 200 to 800.

The method of producing a metal sintered body composite material according to the present invention uses iron base raw material powder of a composition comprising 2 to 70% by weight of at least one element selected from the group consisting of chromium (Cr), molybdenum (Mo), vanadium (V), tungsten (W), manganese (Mn), and silicon (Si), 0.07 to 8.2% by weight of carbon (C), and inevitable impurities;

and comprises the steps of:

- producing a porous metal sintered body which is capable of being gas quenched, has a space lattice structure having pores and a volume percentage of 30 to 88, by sintering a powder molding formed of the iron base raw material powder,
- gas quenching the porous metal sintered body by cooling the porous metal sintered body in gas,
- impregnating the pores of the porous metal sintered body with a molten light metal and solidifying the molten light metal so as to obtain a composite material, and
- heating the composite material into an aging treatment temperature range of the light metal constituting the composite material so as to apply aging treatment to the light metal, whereby the micro-Vickers hardness of a metal constituting the porous metal sintered body is set at 200 to 800.

In the present invention, when a hard material is added, a porous metal sintered body comprises a metal constituting the porous metal sintered body and the hard material. So, the hard material has no concern with the above micro-Vickers hardness.

According to the composite material of the present invention, because the micro-Vickers hardness of a metal constituting a porous metal sintered body is set at 200 to 800, the porous metal sintered body can easily maintain a space lattice structure even when a light metal is softened in an elevated temperature range. Therefore, even when the light metal is softened, the lattice structure of the porous metal sintered body can hold the light metal firmly. So, the light metal can be suppressed from flowing, which is advantageous in improving seizure resistance.

When a porous metal sintered body is quenched in quenching liquid such as oil and water, the quenching liquid often remains in pores of the porous metal sintering body, and causes gas defects when the porous metal sintered body is impregnated with a light metal. In contrast, according to the production method of the present invention, chromium (Cr), molybdenum (Mo), vanadium (V), tungsten (W), manganese (Mn), and/or silicon (Si) each having a high quench-multiplying factor is contained in an appropriate amount so that the porous metal sintered body is capable of being quenched in gas. Besides, the porous metal sintered body has a space lattice structure and the lattice thickness of the porous metal sintered body is smaller than that of a metal mass, and accordingly this porous metal sintered body has much higher cooling power than a metal mass having the same apparent volume as this sintered body. Therefore, the porous metal sintered body can be quenched simply by being left in gas, that is, can be gas quenched, and a quenched phase can be formed on the porous metal sintered body. Therefore, there is no need to employ quenching liquid having high cooling power such as water and oil, and this is advantageous in reducing and avoiding gas defects.

Further, according to the production method of the present invention, since the pores of the porous metal sintered body after gas quenched are impregnated with a molten light metal at high temperatures, the molten light metal at high temperatures directly contacts a quenched phase. Therefore, heat transfer from the molten light metal at high temperatures and heat transfer immediately after the molten light metal is solidified achieve heating of the quenched phase of the porous metal sintered body.

Therefore, the structure of the porous metal sintered body after quenched (in general, retained austenite) is expected to be stabilized. In addition, when the carbon content is high, an alloying element which has been supersaturatedly solid solved in the quenched phase of the porous metal sintered body tends to precipitate in the form of ultrafine hard carbide. This carbide generation is expected to improve abrasion resistance.

In other words, depending on the carbon content in the porous metal sintered body, secondary hardening occurs owing to the carbide generation. As a result, it is possible to further expect an effect of increasing the hardness of a metal constituting the porous metal sintered body, and an effect of improving abrasion resistance owing to the carbide generation. In this respect, this is much advantageous in improving seizure resistance.

Therefore, when a hard material is mixed in the porous metal sintered body as in test specimens described later, the hard material and the carbide can be expected to exhibit a synergetic effect.

Further, according to the production method of the present invention, the porous metal sintered body has a space lattice structure, and a molten light metal at a high temperature is impregnated into the space lattice structure. Consequently, the molten light metal at a high temperature is three-dimensionally and uniformly contacted with the metal constituting the porous metal sintered body so that heat is transferred to the porous metal sintered body. Since uniform heat transfer to the porous metal sintered body can be thus expected, the aforementioned stabilization of the structure after quenched and the aforementioned effect of generating carbide can be expected even on the inside, particularly in the depth of the porous metal sintered body.

Therefore, these facts attribute to a decrease in variations in the hardness of the porous metal sintered body. Also in this respect, the hardness of the porous metal sintered body can be maintained, which is further advantageous in improving seizure resistance.

Further, according to the production method of the present invention, since aging treatment is applied to a light metal constituting the composite material by heating the light metal to an aging treatment temperature range, the light metal in itself can be strengthened by the aging treatment. In addition, because the heat in the aging treatment is transferred to the quenched phase of the porous metal sintered body, the quenched phase of the metal structure of the porous iron base metal sintered body can be more stabilized by the aging treatment for strengthening the light metal. Further, ultrafine hard carbide generates in the quenched phase of the porous metal sintered body, depending on the carbon content. This attributes not only to securing the hardness of the porous metal sintered body, but also to a further improvement in abrasion resistance of the porous metal sintered body. Also in this respect, this is much advantageous in improving seizure resistance.

As mentioned above, since the porous metal sintered body has a space lattice structure and a molten light metal at a high temperature is three-dimensionally and uniformly contacted with the metal constituting the porous metal sintered body, variations in the heat transfer effect can be suppressed even on the inside, particularly in the depth of the porous metal sintered body. Therefore, heat in the aforementioned aging treatment is uniformly transferred to the porous metal sintered body, and accordingly it becomes possible to reduce variations in the aforementioned effect of stabilizing the structure and variations in the aforementioned effect of generating carbides.

In particular, since light metals have higher heat transfer coefficients than iron base materials, the use of light metals is advantageous in suppressing variations in the aforementioned heat transfer effect.

PREFERABLE ASPECTS OF THE INVENTION

Now, the present invention will be described in detail.

As a feature of the porous metal sintered body according to the present invention, the micro-Vickers hardness of a metal constituting the porous metal sintered body is set at 200 to 800. Owing to this feature, even when a light metal is softened in use, the porous metal sintered body can secure its space lattice structure and can exhibit sufficient seizure resistance. The micro-Vickers hardness of less than 200 results in a small strength of the porous metal sintered body. So, the porous metal sintered body together with a light metal tends to make a plastic flow on a sliding surface, and the sliding surface tends to be roughened by seizure. From these viewpoints, a metal constituting the porous metal sintered body preferably has a composition in which the micro-Vickers hardness is maintained at not less than 200 even after impregnation and solidification of a light metal and even after aging treatment of the light metal. However, too high hardness of the porous metal sintered body is not preferable, because the composite material tends to have lowered machinability. In consideration of the above respects, the lower limit of the micro-Vickers hardness of the metal constituting the porous metal sintered body is set, for example at 210, 230, 250 or 300, and the upper limit is set, for example at 700, 600 or 500. The micro-Vickers hardness is preferably in the range from about 200 to about 500, and more preferably in the range from about 220 to about 400.

A metal structure constituting the porous metal sintered body may include at least one metal structure selected from the group consisting of martensite, bainite, pearlite, fine pearlite and so on, or the mixed metal structure thereof.

When the porous metal sintered body is quenched by cooling the body in water, oil, or the like, the water, oil or the like tends to remain in pores of the porous metal sintered body, and causes gas defects on an obtained composite material. To prevent gas defects, it is possible to employ a method of evaporating the water, oil or the like in the pores for removal by placing the porous metal sintered body impregnated with the water, oil or the like, in an atmosphere under reduced pressure or in a vacuum atmosphere. The employment of this method, however, increases the steps of the production method and the production costs. Therefore, according to preferable aspects of the present invention, the composition of the metal constituting the porous metal sintered body is defined so as to be capable of being quenched even by cooling in air or other gases, which has a relatively slow cooling rate. For this purpose, according to the preferable aspects of the present invention, the porous metal sintered body includes, in addition to carbon (C), an appropriate amount of at least one element of chromium (Cr), molybdenum (Mo), vanadium (V), tungsten (W), manganese (Mn), and silicon (Si) as a quenching element. Each of these elements has a high multiplying factor.

Further, since the lattice thickness of the space lattice structure of the porous metal sintered body is smaller than that of a metal mass, the surface area of the porous metal sintered body per unit weight can be increased. In this respect, the cooling rate in quenching can be increased, even in the depth of the porous metal sintered body. Therefore, without contacting such liquid as water and oil having a high cooling capacity, the porous metal sintered body can be gas quenched by the inclusion of appropriate amounts of alloying elements having a high multiplying factor, and the small thickness of the lattice. Therefore, it is possible to stop employing the step of removing the water, oil or the like remaining in the porous metal sintered body, and at the same time this is advantageous in lessening and preventing gas defects inside the composite material.

Further, the aforementioned chromium (Cr), molybdenum (Mo), vanadium (V), and tungsten (W) can also be expected to function as carbide generating elements. Particularly when the porous metal sintered body includes high carbon, the alloying elements which have been supersaturatedly solid solved in the quenched phase tend to precipitate in the form of hard carbides (chromium carbide, molybdenum carbide, vanadium carbide and tungsten carbide), and moreover, the carbides precipitate in an ultrafine form. The carbide generation enables an increase in the hardness of the porous metal sintered body, particularly secondary hardening.

According to preferable aspects of the present invention, the examples of a suitable composition of a metal constituting the porous metal sintered body may include an equivalent of JIS-SKD, which is alloy tool steel, an equivalent of JIS-SKH, which is high speed steel, and Fe-Mn steel.

The present inventors have studied about the preferable composition of a metal of the porous metal sintered body which gives a necessary hardness to the metal sintered body composite material. As a result, they have found that in view of a desired metal structure, secureness of hardenability, technical factors such as an increase in the hardness and the like due to carbide generation, and economic factors such as marketability and costs of raw materials, the metal preferable composition can be defined as follows based on the total weight of the porous metal sintered body, depending on the priority of these factors.

(1) The composition of a metal constituting the porous metal sintered body essentially includes, for example 0.1 wt. % to 8.0 wt. % of carbon (C), and 2.0 wt. % to 70.0 wt. % of chromium (Cr). In this case, the upper limit of the Cr content can be set at 60 wt. %, 50 wt. %, and 40 wt. %, and the lower limit of the Cr content can be set at 3 wt. % and 7 wt. %.

(2) The composition of a metal constituting the porous metal sintered body essentially includes, for example 0.1 to 3.0 wt. % of carbon, 1.7 to 20.0 wt. % of chromium, and 0.3 to 30.0 wt. % of at least one element of molybdenum (Mo), vanadium (V), tungsten (W), cobalt (Co), and manganese (Mn). In this case, the upper limit of the Cr content can be set at 15 wt. %, and 18 wt. %. The upper limit of the content of at least one element of Mo, V, W, Co, and Mn can be set at 25 wt. %, 20 wt. %, 15 wt. %, and 10 wt. %, and its lower limit can be set at 0.5 wt. %, 1 wt. %, 3 wt. %, and 5 wt. %.

(3) The composition of a metal constituting the porous metal sintered body essentially includes, for example 0.1 to 8.0 wt. % of carbon (C), and 10.0 to 50.0 wt. % of manganese (Mn). The upper limit of the Mn content can be set at 40 wt. %, 30 wt. %, and 20 wt. %, and its lower limit can be set at 13 wt. %, 15 wt. %, and 20 wt. %.

(4) The carbon content in the porous metal sintered body can be varied, depending on circumstances such as of quenched phase generation and carbide generation.

Considering factors such as the secureness of hardenability and the increase in the hardness due to the carbide generation, the lower limit of the carbon content can generally be set at, for example 0.08 wt. %, 0.1 wt. %, 0.2 wt. %, and 0.3 wt. %, and the upper limit of the carbon content can be set, for example, at 1.6 wt. %, 1.8 wt. %, 2.0 wt. %, and 5.0 wt. %, based on the total weight of the porous metal sintered body. It is preferable that the carbon content is defined in this range in accordance with necessity.

The porous metal sintered body may be, for example, any one of low carbon alloys containing 0.07 to 0.3 wt. % carbon, medium carbon alloys containing 0.3 to 0.8 wt. % carbon, and high carbon alloys containing 0.8 to 3.0 wt. % carbon.

A preferred composition of the porous metal sintered body includes, for example, 0.5 to 1.2 wt. % C, 5.8 to 8.7 wt. % Cr, 0.1 to 0.6 wt. % Mo, 0.1 to 0.6 wt. % V, inevitable impurities, and the balance substantially of iron, based on the total weight of the porous metal sintered body.

According to the preferable aspects of the present invention, volume percentage of the porous metal sintered body is defined at 30 to 88% in order to secure strength of the aforementioned porous metal sintered body and a ratio of the light metal. If there is not a certain area of connecting the lattices of the metal of the porous metal sintered body, the metal cannot function as a structural member for supporting the light metal, and a trouble tends to occur in handling powder moldings (in general, powder compressed articles) and porous metal sintered bodies. Further, when the volume percentage of the porous metal sintered body is excessively high, gaps in a surface layer of the porous metal sintered body become small and the pores become isolated holes, and accordingly, superior interconnecting pores cannot be obtained. Therefore, the ability of the porous metal sintered body to soak a molten light metal is lowered and the weight of the porous metal sintered body tends to be increased. In view of the above respects, the upper limit of the volume percentage of the porous metal sintered body can be set, for example, at 80%, 75%, and 70%, and the lower limit can be set, for example, at 40%, 45%, and 50%. A preferred range of the volume percentage is 55 to 85%.

The volume percentage of the porous metal sintered body is calculated from the following formula (1):

$$\text{Volume percentage}=[W/(V\times p)]\times 100\% \quad (1)$$

where V is the apparent volume of the porous metal sintered body, W is the actual weight of the porous metal sintered body, and p is the specific gravity of the metal constituting the porous metal sintered body.

With respect to particle shape of the raw materials, undefined or irregular shapes are preferred to sphere, because they are good for increasing the number of pores (especially, interconnecting pores) so that the volume percentage of the porous metal sintered body is maintained low.

Preferably, the sintering temperature is defined so as not to form a liquid phase for the purpose of securing pores. Although the sintering temperature varies with the content of alloying elements in the raw material, in general, the upper limit of the sintering temperature can be set at about 1200° C., and 1100° C., and the lower limit can be set at about 900° C. and 1000° C. The sintering time varies with the sintering temperature, but generally ranges approximately, for example, from 15 minutes to 2 hours.

Further, according to the composite material of the present invention, it is also preferable to mix a hard material such as hard particles and hard fibers in the porous metal sintered body, in order to improve abrasion resistance. The hard material can be mixed in the step of preparing raw materials, that is, the step of preparing a powder molding (in general, a powder compressed article). But, a large mixed amount of the hard material results in a deterioration in the sliding characteristics. This is because drop of the hard material causes abrasion by scratching and hurting. Further, when the hard material is ceramics such as silicon carbide (SiC) and alumina, the affinity of the hard material and the metal constituting the porous metal sintered body tends to be lowered. On the other hand, when the hard material is a metal or an intermetallic compound, the affinity of the hard material and the metal constituting the porous metal sintered body tends to be easily secured and the hard material tends to be easily suppressed from being dropped.

An experiment by the present inventors revealed that addition of a very hard material having a micro-Vickers hardness of 2500 or more (for example, SiC particles, alumina particles and other ceramic particles) is liable to roughen the sliding surface. On the other hand, addition of a hard material having a micro-Vickers hardness of 2000 or less rarely roughens the sliding surface. These reasons are assumed that a hard material having a micro-Vickers hardness of more than 2000 has such a strong ability of attacking a mating member that abraded powder of the mating member is held between the sliding surfaces so as to roughen the sliding surface of the composite material. Therefore, the micro-Vickers hardness of the hard material is preferably not more than 2000. It is enough that the hard material is harder than that of a metal constituting the porous metal sintered body. It is preferable that the hard material is harder than that of the metal constituting the porous metal sintered body by not less than 100 micro-Vickers hardness. The hard material may include powder of steel such as JIS-SKD61, JIS-SKH57 or the like, powder of an intermetallic compound such as FeCr, FeMo, FeCrC and the like, a ceramic powder having relatively low hardness such as mullite and the like. In view of the above circumstances, the upper limit of the mixing ratio of the hard material can be set, for example, at 50%, 40%, 20%, and 10% by volume, and the lower limit can be set, for example, at 1%, 3%, and 5% by volume, based on the total volume of the porous metal sintered body. Thus, the volume percentage of the hard material can range from 1 to 40% by volume. The upper limit of the mixing ratio of the hard material is set, for example, at not more than 35%, preferably, not more than 20% by volume, based on the total volume of the composite material. An addition of a small amount of the hard material is effective. However, in order to clearly obtain an effect of an addition of the hard material, the lower limit of the mixing ratio of the hard material is set at not less than 1%, preferably, not less than 3% by volume. The particle diameter of the hard material can have an upper limit of approximately 300 microns, 200 microns, and 100 microns, and a lower limit of approximately 1 micron, 5 microns, and 10 microns.

Examples of the aforementioned light metals may include aluminum alloys and magnesium alloys. The aluminum alloys may contain at least one element of magnesium (Mg), silicon (Si), copper (Cu), zirconium (Zn), and manganese (Mn), and examples of suitable aluminum alloys include Al—Si alloys, Al—Cu alloys, Al—Mn alloys, and Al—Mn—Mg alloys. According to the composite material of the present invention, employable aluminum alloys include both alloys which require aging treatment and alloys which do not require aging treatment. According to the production method of the present invention, employable aluminum alloys require aging treatment. Aging treatment is a process of precipitating, for example, as a Guinier-Preston zone, an element which has been supersaturatedly solid solved by solution heat treatment in which an alloy is rapidly cooled after heating and holding the alloy at the elevated temperature. According to the production method of the present invention, the aging treatment temperature is preferably not less than 100° C. The aging treatment temperature is appropriately varied with factors such as the composition of the light metal and desired characteristics. When aluminum alloys are employed, the upper limit of the aging treatment temperature can be, for example, 550° C., 500° C., 450° C., and 400° C., and the lower limit can be, for example, 130° C., 150° C., 170° C., and 200° C.

The micro-Vickers hardness of the composite material according to the present invention (under a load of 10 kg) is preferably from 240 to 360.

BRIEF DESCRIPTION OF THE DRAWINGS

The exact nature of this invention, as well as other objects and advantages thereof, will be readily apparent from consideration of the following specification relating to the annexed drawings in which.

Figure 1:
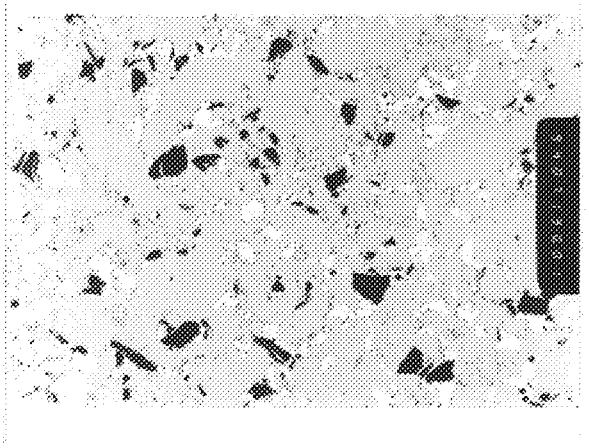
FIG. 1 is an optical microphotograph of Test Specimen C.

relatively low carbon of 0.2 wt. % based on the total weight of this powder. Powder b was an equivalent of SKD61 including relatively high carbon of 1.2 wt. %. Powder c was an equivalent of SKD11 including relatively high carbon of 1.5 wt. %. Powder d was an equivalent of SKH57 including relatively high carbon of 1.3 wt. %. Powder e was an equivalent of SUS410 including low carbon of 0.02 wt. %. Powder f was an equivalent of SUS304 including low carbon of 0.02 wt. %.

Further, as shown in Table 1, Powder g was pure iron (Fe) powder. Powder h was Fe-Mn steel powder. Powder i was carbon (C) powder. Powder j was SiC particles. Powder k was alumina particles, Powder l was mullite particles. Powder m was particles of ferrochrome (FeCr), which is an intermetallic compound. Powder n was particles of ferromolybdenum (FeMo), which is an intermetallic compound. Powder o was particles of FeCrC, which is an intermetallic compound. The particle diameters of Powders a to f were in the range from 20 to 180 microns. The particle diameters of Powders g to o are shown in Table 1. The micro-Vickers hardness of Powders j to o are also shown in Table 1. Powders a to h were atomized powders.

TABLE 1

| POWDER | MATERIAL | COMPOSITION (WT %) | MANUFACTURER (all in Japan) | HARDNESS |
|---|---|---|---|---|
| a | JIS-SKD61 EQUIVALENT | Fe-0.2C-1Si-0.4Mn-5Cr-1.3Mo-1V | MITSUBISHI STEEL MFG. CO. LTD | — |
| b | JIS-SKD61 EQUIVALENT | Fe-1.2C-1Si-0.4Mn-5Cr-1.3Mo-1V | same as above | — |
| c | JIS-SKD61 EQUIVALENT | Fe-1.5C-0.4Si-0.4Mn-12Cr-1Mo-0.8V | same as above | — |
| d | JIS-SKH57 EQUIVALENT | Fe-1.3C-0.3Si-0.2Mn-4Cr-3.5Mo-3.3V-10W-10Co | same as above | — |
| e | JIS-SUS410 EQUIVALENT | Fe-0.02C-0.9Si-0.2Mn-12.5Cr | DAIDO STEEL CO. | — |
| f | SUS304 EQUIVALENT | Fe-0.02C-0.9Si-0.2Mn-10.5Ni-19Cr | same as above | — |
| g | PURE Fe | D.: 20~180 μm | HEGANESU CO, LTD | — |
| h | Fe—Mn STEEL | Fe-0.5C-18Mn D.: 30~250 μm | Produced by themselves by water atomizing | — |
| i | CARBON POWDER | C: 99.5 AVERAGE D.: 10 μm | NIPPON KOKUEN KOGYO K.K. | — |
| j | SiC PARTICLES | SiC 95% AVERAGE D.: 15 μm | SHOWA DENKO K.K. | Hv 3200 |
| k | ALUMINA PARTICLES | $Al_2O_3$ 98% D.: 10~45 μm | same as above | Hv 2700 |
| l | MULLITE PARTICLES | $Al_2O_3$ 76%-$SiO_2$24% D.: 10~45 μm | same as above | Hv 1500 |
| m | FeCr PARTICLES | Fe-65Cr D.: 63 μm or less | FUKUDA KINZOKU HAKUKO K.K. | Hv 1700 |
| n | FeMo PARTICLES | Fe-61Mo D.: 63 μm or less | same as above | Hv 1400 |
| o | FeCrC PARTICLES | Fe-7.3C-64Cr D.: 45 μm or less | same as above | Hv 800 |

PREFERRED EMBODIMENTS OF THE PRESENT INVENTION

Preferred Embodiment 1

<Preparation of Raw Material Powder>

Powders a to o in Table 1 were employed as raw material powders. Powder a was an equivalent of SKD61 including <Powder Pressing Step>

A predetermined amount of each raw material powder was weighed, and 1 wt. % of zinc stearate as a lubricant in molding was weighed based on the total weight of each raw material powder. Then the weighed raw material powder and zinc stearate were mixed by a V-type powder mixing apparatus for 10 to 50 minutes, so as to obtain mixed powder. A predetermined amount of mixed powder was fed into a cavity of a die having an inner diameter of 40 mm, and then a punch was pressed into the die, thereby obtaining a powder compressed article which is a powder molding having an inner diameter of 40 mm and a thickness of 10 mm.

<Sintering Step>

Next, the powder compressed article was placed in a vacuum sintering furnace and sintered. Sintering was conducted by first holding the article at 700° C. for thirty minutes to volatilize zinc stearate. Then, the temperature was increased from 700° C. to 1100° C., and the article was held at 1100° C. for thirty minutes to obtain a porous iron base metal sintered body.

<Gas Quenching Step>

After sintering, nitrogen gas was introduced into the sintering furnace so that the porous metal sintered body was cooled in gas to an ordinary temperature area at a cooling rate of 100° C. per minute. Thus, a gas quenching step was conducted. The nitrogen gas was employed mainly for suppressing oxidization of the porous metal sintered body. Experiments by the present inventors revealed that porous sintered bodies having equal quality could be produced even when sintering treatment and gas cooling treatment (at a cooling rate of 20° to 30°/C. were applied in a reducing atmosphere including reducing gas such as hydrogen gas, ammonia decomposition gas, and exothermic gas obtained by burning butane and so on.

Test Specimens A to Q shown in Table 2 were produced by the aforementioned steps. Table 2 shows, in regard to Test Specimens A to Q, the kind of raw material powder employed for forming each porous metal sintered body, the volume percentage of a metal constituting the porous metal sintered body, and the micro-Vickers hardness (an average of five points under a load of 300 g) of a metal constituting the porous metal sintered body after a molten aluminum alloy was impregnated into the porous metal sintered body and solidified and aging treatment was applied. The raw material of Test Specimen C shown in Table 2 was prepared by adding Powder i (carbon powder) to Powder a (an equivalent of JIS-SKD61) shown in Table 1 in an amount of 0.1 wt. %, and the raw material of Test Specimen E was prepared in the same way as that of Test Specimen C. The raw material of Test Specimen O shown in Table 2 was prepared by mixing Powder g (pure Fe powder) shown in Table 1 and Powder i (carbon powder) so as to contain 0.8 wt. % of carbon. The raw materials of Test Specimens P and Q shown in Table 2 were prepared in the same way as that of Test Specimen O.

TABLE 2

| | METAL CONSTITUTING POROUSMETAL SINTERED BODY | | |
|---|---|---|---|
| TEST SPECIMEN | KIND OF RAW MATERIAL POWDER | Vol. % | AVERAGE HARDNESS (mHv) |
| A | a | 45 | 290 |
| B | a | 60 | 310 |
| C | a + i (0.1 wt % C) | 60 | 380 |
| D | a | 55 | 305 |
| E | a + i (0.1 wt % C) | 65 | 370 |
| F | c | 70 | 720 |
| G | c | 45 | 690 |
| H | c | 55 | 705 |

TABLE 2-continued

| | METAL CONSTITUTING POROUSMETAL SINTERED BODY | | |
|---|---|---|---|
| TEST SPECIMEN | KIND OF RAW MATERIAL POWDER | Vol. % | AVERAGE HARDNESS (mHv) |
| I | e | 60 | 185* |
| J | e | 50 | 190* |
| K | f | 60 | 185* |
| L | f | 55 | 183* |
| M | f | 65 | 187* |
| N | h | 60 | 230 |
| O | g,i Fe-0.8C | 60 | 125* |
| P | g,i Fe-0.8C | 65 | 130* |
| Q | g,i Fe-1.5C | 60 | 140* |

(*: except for claims)

Further, Table 3 shows, in respect to Test Specimens A to Q, the kind of a hard material added to each porous metal sintered body, the percentage by volume of the hard material (based on the total volume of the composite material), the micro-Vickers hardness of the hard material, heat treatment applied to each composite material, and seizure test results.

Only Test Specimens O, P, and Q, which were comparative examples, were heated at 850° C. for thirty minutes under vacuum after sintering, and then placed in oil for oil quenching. Since some oil adhered to pores of these porous metal sintered bodies, the oil was removed by evaporation under vacuum, by using a Soxhlet extractor (a solvent: ether).

<Impregnation Step>

The obtained sintered body of each test specimen was preheated at 400° C. for fifteen minutes. Then each sintered body was placed in a cavity of a squeeze casting mold, and then an aluminum alloy (JIS AC8A) at 750° C. was poured, and promptly a pressure of 100 MPa was applied, thereby obtaining a composite material. It must be noted that a target main composition of JIS AC8A includes 0.8 to 1.3 wt. % copper (Cu), 11 to 13 wt. % silicon (Si), and 0.7 to 1.3 wt. % magnesium (Mg).

Immediately after removed from the mold, the composite material was placed in hot water at 60° C. or more for immediate quenching.

<Aging Treatment Step>

As appreciated from Table 3, the composite materials of Test Specimens A to J were subjected to T5 treatment, i.e., aging treatment at 220° C. for three hours. The composite materials of Test Specimens O, P, and Q, which were comparative examples, were also subjected to the T5 treatment, i.e., aging treatment at 220° C. for three hours.

As appreciated from Table 3, the composite materials of Test Specimens K to N were subjected to T7 treatment. This T7 treatment is to apply solution heat treatment at 500° C. for three hours, immediately after that, apply quenching treatment by placing the materials in hot water at 60° C. or more, and then apply aging treatment by heating and holding the resultant materials at 220° C. for three hours.

TABLE 3

| TEST SPECIMEN | HARD PARTICLES ADDED TO POROUS METAL SINTERED BODY KIND | vol. % | AVERAGE HARDNESS mHv | HEAT TREAT MENT OF COMPOSITE MATERIAL | SEIZURE TEST RESULT | PRE-FERRED EMBODI-MENT | COMPRA-TIVE EXAMPLE |
|---|---|---|---|---|---|---|---|
| A | b | 20 | 690 | T5 | ○ | ○ | |
| B | k | 5 | (2700) | ↑ | X | | ○ |
| C | l | 5 | (1500) | ↑ | ○ | ○ | |
| D | m | 10 | (1700) | ↑ | ○ | ○ | |
| E | none | — | — | ↑ | ○ | ○ | |
| F | J | 5 | (3200) | ↑ | X | | ○ |
| G | d | 20 | 820 | ↑ | ○ | ○ | |
| H | n | 10 | (1400) | ↑ | ○ | ○ | |
| I | l | 5 | (1500) | ↑ | X | | ○ |
| J | d | 20 | 790 | ↑ | X | | ○ |
| K | k | 5 | (2700) | T7 | X | | ○ |
| L | m | 10 | (1700) | ↑ | X | | ○ |
| M | none | — | | ↑ | X | | ○ |
| N | o | 20 | 800 | ↑ | ○ | ○ | |
| O | n | 10 | (1400) | T5 | X | | ○ |
| P | none | — | | ↑ | X | | ○ |
| Q | l | 5 | (1500) | ↑ | X | | ○ |

( ): ESTIMATED VAL

Figure 2:
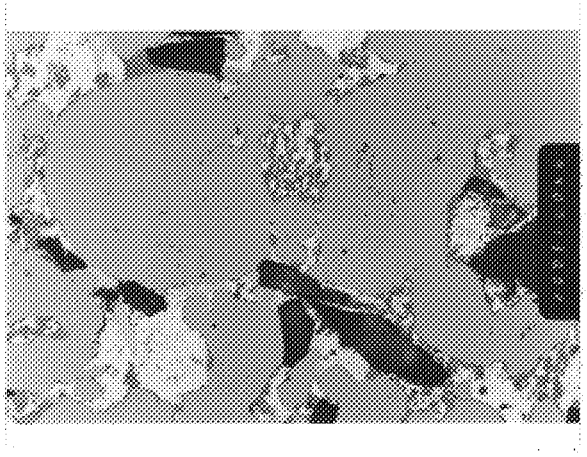
FIG. 2 is an optical microphotograph of Test Specimen C at a higher magnification.

FIG. 1 shows an optical microscopic structure of the composite material of Test Specimen C, and FIG. 2 shows the structure of Test Specimen C at a higher magnification. In FIGS. 1 and 2, the porous metal sintered body is shown as island areas, the aluminum alloy is shown as sea areas which impregnated into the porous metal sintered body, and the black particles are mullite particles as a hard material.

(Evaluation)

<Seizure Test>

Seizure test specimens in a plate shape were cut from the composite materials thus obtained, and subjected to a seizure test. A mating member was in a sleeve shape having an inner diameter of 25 mm, an outer diameter of 30 mm, and a height of 40 mm. The material of the mating member was defined as two kinds, i.e., nitrided stainless steel and hardened bearing steel (JIS SUJ2) in consideration of the material of a piston ring. This seizure test was conduced by rotating the mating member at a peripheral speed of 0.5 mm/sec at an atmosphere temperature of 250° C., and at the same time pressing a shaft end surface of the sleeve-shaped mating member against each test specimen in a plate shape under a load of 200N.

Judgment of seizure test results were done by observing the sliding surface of each seizure test specimen by an electron microscope. A retained microstructure of the composite material was regarded as 'SUCCESS', and a vague microstructure of the composite material was regarded as 'FAILURE'.

Figure 3:
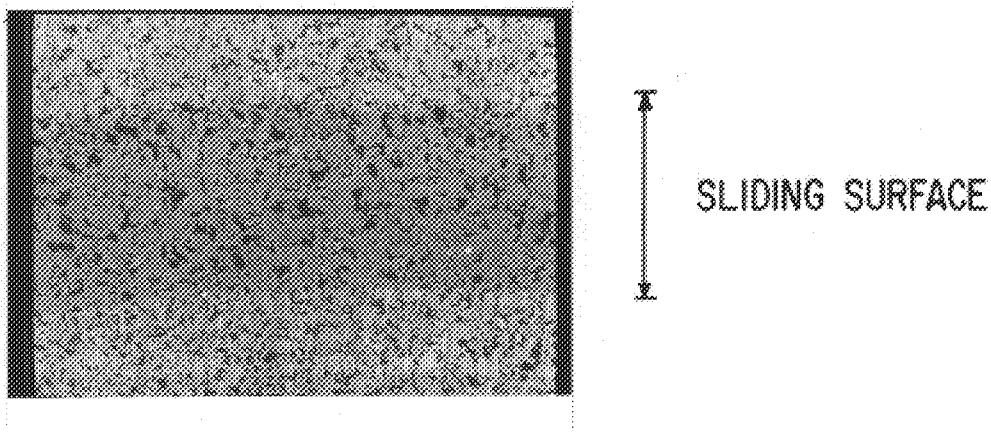
FIG. 3 is an optical microphotograph of a sliding surface of a seizure test specimen of Test Specimen C.
Figure 4:
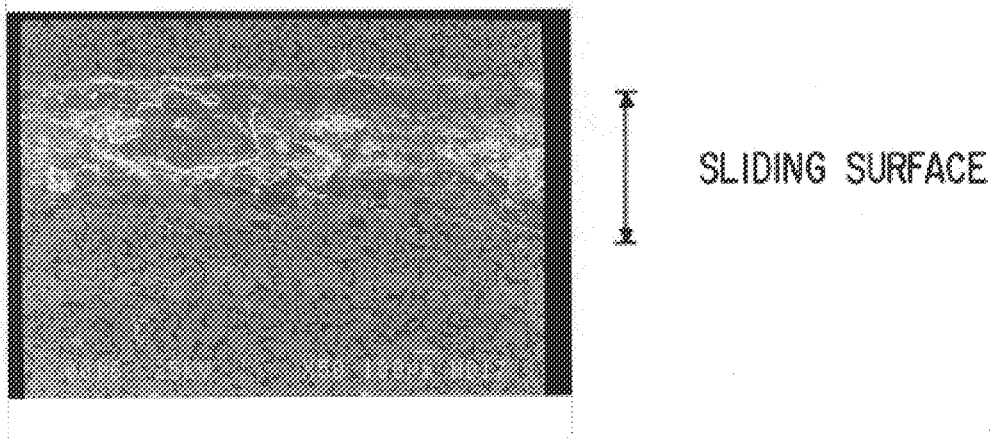
FIG. 4 is an optical microphotograph of a sliding surface of a seizure test specimen of Test Specimen B.

The microphotograph of Test Specimen C is shown as an example of success in FIG. 3, and the microphotograph of Test Specimen B is shown as an example of failure in FIG. 4. In both of FIGS. 3 and 4, the upper face in a direction perpendicular to the sheet of paper was a sliding surface. As shown in the microphotograph of FIG. 3, the sliding surface was observed as a discolored mark, because the sliding surface was slided against and abraded by the mating member. The sliding surface was slightly curved because of an effect of curvature of the sleeve-shaped mating member. It is clear from FIG. 3 that the structure of the composite material on the sliding surface was maintained, and that the seizure resistance was superior. On the other hand, FIG. 4 shows that the structure of the composite material on the sliding surface was not maintained.

Although two kinds of mating members were used in this seizure test, there was no difference between the materials of the mating member in the test results. The porous metal sintered bodies having a micro-Vickers hardness of 200 or less shown in Table 2, i.e., Test Specimens I, J, K, L, M, O, P, and Q exhibited seizure test results marked with 'FAILURE', as shown in Table 3. It is also apparent from the seizure test results shown in Table 3 that the composite materials including a hard material having a micro-Vickers hardness over 2000, i.e., Test Specimens B and F also showed test results marked with 'FAILURE'. Test Specimens B and F, however, could exhibit satisfactory results, if the hardness of the hard materials was decreased.

Figure 5:
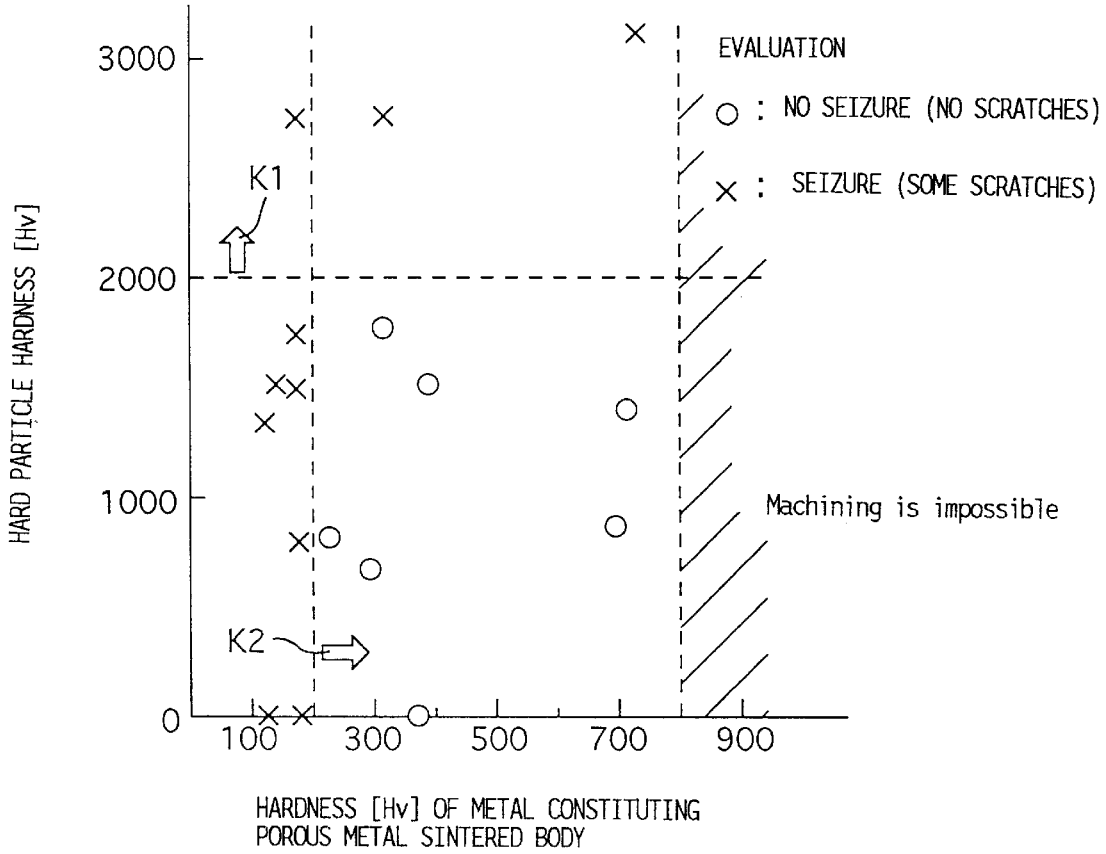
FIG. 5 is a graph showing a relation between hardness of hard particles, hardness of a metal constituting a porous metal sintered body, and seizure test results.

Further, a relation between the hardness of the metal constituting the porous metal sintered body, the hardness of the hard particles, and seizure resistance was investigated. The results are presented in FIG. 5. In FIG. 5, a circle indicates that no seizure (scratches) was observed, and a cross indicates that seizure (scratches) was observed. As appreciated from an arrow K1 in FIG. 5, when the micro-Vickers hardness of the hard particles exceeded 2000, results of seizure resistance evaluation were marked with crosses, which means that seizure was observed. In addition, as appreciated from an arrow K2 in FIG. 5, when the micro-Vickers hardness of the metal constituting the porous metal sintered body was less than 200, the results of seizure resistance evaluation were marked with crosses. It is apparent from this seizure test that the micro-Vickers hardness of the metal constituting the porous metal sintered body over 200 achieves an improvement in seizure resistance, and that the micro-Vickers hardness of the hard particles is preferably less than 2000. In FIG. 5, the hatched area indicates an area where the composite materials could not be cut due to excessive hardness. That is to say, when a metal constituting the porous metal sintered body has a micro-Vickers hardness over 800, practical machining is virtually impossible.

<Abrasion Resistance Test>

A LFW abrasion test was applied for abrasion resistance evaluation of the materials of the test specimens which passed the aforementioned seizure test. In this LFW abrasion test, annular abrasion test specimens each having a diameter of 30 mm were prepared from two kinds of materials i.e., nitrided stainless steel and a material corresponding to that of a piston ring. Each abrasion test specimen was rotated about its axis at 160 rpm, while a mating block was pressed against an outer circumferential surface of each abrasion test specimen under a predetermined load. Test conditions were as follow: The load was 590N, sliding time was 60 minutes, the atmosphere was air at room temperature. A comparative abrasion test specimen was also prepared by using Ni-resist cast iron, and similarly subjected to the LFW abrasion test.

Figure 6:
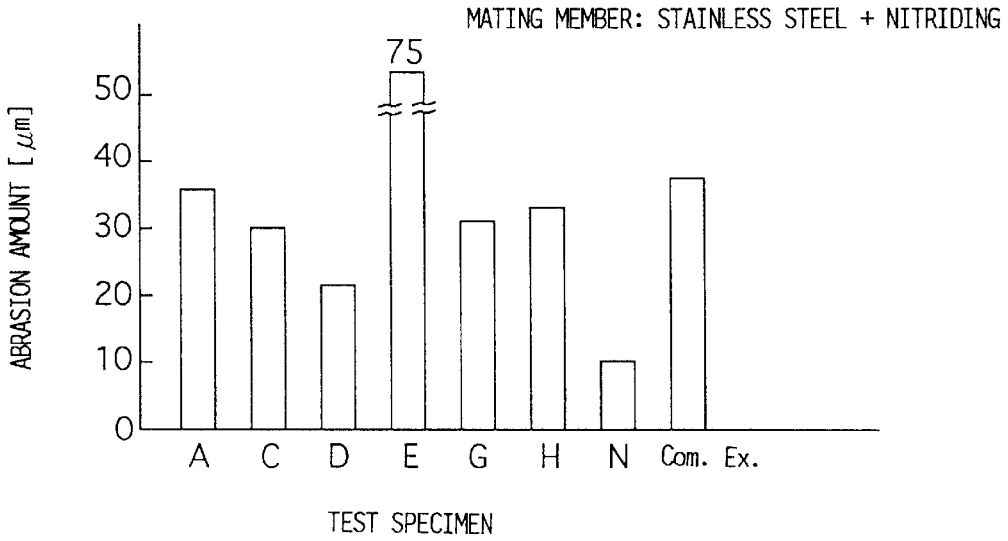
FIG. 6 is a graph showing an abrasion test result of each test specimen.

FIG. 6 shows LFW abrasion test results. The axis of abscissa shows the kind of test specimens, and the axis of ordinate shows the abrasion amounts. As appreciated from FIG. 6, Test Specimen A had an abrasion amount of approximately 36 microns, Test Specimen C had an abrasion amount of approximately 30 microns, Test Specimen D had an abrasion amount of approximately 21 microns, Test Specimen E had an abrasion amount of approximately 75 microns because of no inclusion of hard particles, Test Specimen G had an abrasion amount of approximately 31 microns, Test Specimen H had an abrasion amount of approximately 34 microns, Test Specimen N had an abrasion amount of approximately 10 microns. In summary, Test Specimens A to N except Test Specimen E showed equal or superior abrasion resistance to that of the comparative example formed of Ni-resist cast iron.

(Application Examples)

Figure 7:
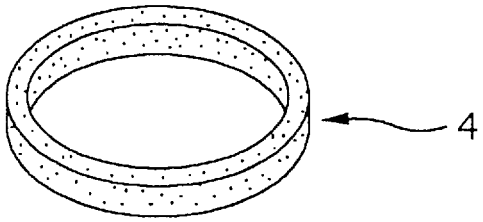
FIG. 7 is a perspective view of a ring comprising a porous metal sintered body.
Figure 8:
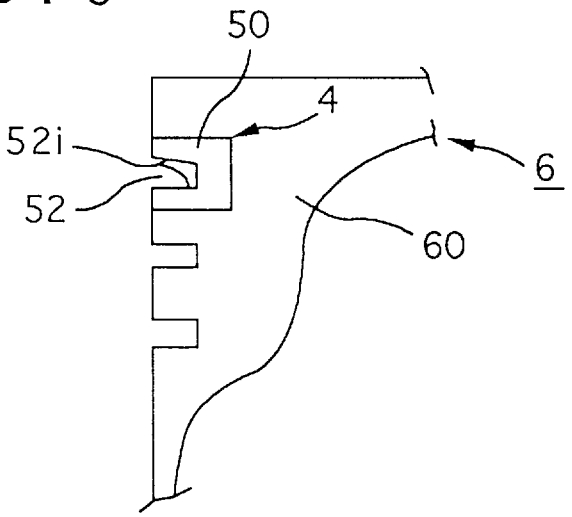
FIG. 8 is a cross sectional view of a part of a piston showing the vicinity of a ring groove.

A ring 4 shown in FIG. 7 and formed of a porous metal sintered body having a space lattice structure was prepared from each material of Test Specimens B and C. After the ring 4 was placed in a cavity of a die for casting a piston, a molten aluminum alloy (JIS AC8A) was poured to impregnate into the ring and solidified, to obtain a piston 6 comprising a composite material 50 and a main body 60, as shown in FIG. 8.

Next, an endurance test was performed by forming a piston top ring groove 52 on the composite material 50 by cutting, and assembling this piston 6 to an actual engine (a 3-liter diesel turbo engine). It must be noted that a top ring was put on the piston top ring groove 52, and that the top ring and the piston top ring groove 52 slided against each other while the engine was driven. The experiment was conducted under the full load at 3000 rpm for 200 hours. Endurance test results were the same as the results of the examinations of the composite materials in the form of the aforementioned test specimens: The piston 6 formed of the material of Test Specimen B caused seizure (surface roughening) on a sliding surface **52*i* which is a surface forming a ring groove 52. The piston 6** formed of the material of Test Specimen C caused no seizure (no surface roughening).

Figure 9:
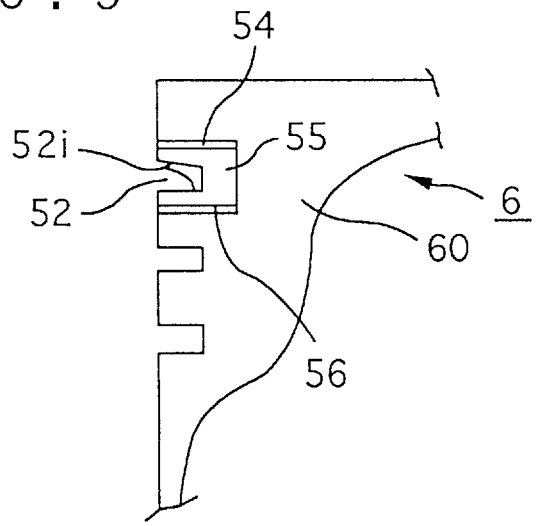
FIG. 9 is a cross sectional view of a part of another piston showing the vicinity of a ring groove.

As a modification of the piston 6 is shown in FIG. 9, the aforementioned composite material 5 may be formed by laminating three layers in the thickness direction. In this case, the composite material 5 comprises a first layer 54, a second layer 55, and a third layer 56, and each of the layers is formed by impregnating the porous metal sintered body having a space lattice structure with an aluminum alloy (AC8A) and solidifying the aluminum alloy in the same way as above. The second layer 55 is formed of the material of Test Specimen C.

The thermal expansion coefficients of the first layer 54 and the third layer 56 were set larger than that of the second layer 55.

The thermal expansion coefficient of an aluminum alloy constituting the piston 6 generally ranges approximately from $19.0\times10^{-6}/°$ C. to $21.0\times10^{-6}/°$ C. On the other hand, since the composite material of the second layer 55 was formed by impregnating a porous iron base metal sintered body with an aluminum alloy and solidifying the aluminum alloy, the composite material of the second layer 55 has a smaller thermal expansion coefficient than an aluminum alloy alone owing to an effect of iron. Therefore, a considerably severe thermal shock in quenching treatment such as solution heat treatment sometimes causes cracks in the boundary between the composite material 5 and the main body 60.

In this respect, in the embodiment shown in FIG. 9, since the first layer 54 and the third layer 56 formed of materials having more similar thermal expansion coefficients to that of the aluminum alloy than that of the second layer 55 sandwich the second layer 55, the difference in thermal expansion coefficient between the composite material 5 and the main body 60 can be made smaller. Therefore, even when thermal shock is considerably severe, it is possible to improve an effect of suppressing cracks at the boundary between the composite material 5 and the main body 60. In this example, the difference between the thermal expansion coefficients of the first layer 54 and the third layer 56 of the composite material 5 and the thermal expansion coefficient of the main body 60 is set at $2.0\times10^{-6}/°$ C. to $5.0\times10^{6}/°$ C.

Preferred Embodiment 2

The results of Preferred Embodiment 1 revealed that an equivalent of SKD, an equivalent of SKH, and high Mn-high C steel were superior as the metal composition of the porous metal sintered body. Therefore, the present inventors investigated composition ranges of the porous metal sintered body which can exhibit a micro-Vickers hardness of 200 or more by reducing the aforementioned elements as much as possible in view of the production costs.

In Preferred Embodiment 2, Powders 1 to 13 having composition shown in FIG. 4 were prepared, and a porous metal sintered body was formed from each powder in the same method as in Preferred Embodiment 1, and a molten aluminum alloy (AC8A) was impregnated into pores of each porous metal sintered body and solidified in the same way as in Preferred Embodiment 1, to produce each composite material.

As shown in Table 4, the composition of Test Specimen 1 was prepared by removing silicon (Si), manganese (Mn), molybdenum (Mo) and vanadium (V) and decreasing carbon (C) from an equivalent of SKD11. The composition of Test Specimen 2 was prepared by decreasing carbon (C) and chromium (Cr) from the powdery composition of Test Specimen 1. The composition of Test Specimen 3 was prepared by reducing chromium (Cr) from the powder composition of Test Specimen 2. The composition of Test Specimen 4 was prepared by removing silicon (Si) and manganese (Mn) and reducing carbon (C) and chromium (Cr) from an equivalent of SKD 61. The composition of Test Specimen 5 was was prepared by reducing molybdenum (Mo) and removing vanadium (V) from the powdery composition of Test Specimen 4. The composition of Test Specimen 6 was prepared by reducing vanadium (V) and removing molybdenum (Mo) from the powdery composition of Test Specimen 4. The composition of Test Specimen 7 was prepared by removing molybdenum (Mo) and vanadium (V) and adding tungsten (W) to the powdery composition of Test Specimen 4. The composition of Test Specimen 8 was prepared by removing molybdenum (Mo) and vanadium (V) and adding cobalt (Co) to the powdery composition of Test Specimen 4. The composition of Test Specimen 9 was prepared by reducing carbon (C), copper (Cu), and manganese (Mn) from an equivalent of SKD. The composition of Test Specimen 10 was prepared by removing cobalt (Co) from the powdery composition of Test Specimen 8. The composition of Test Specimen 11 was prepared by reducing carbon (C) from Fe-Mn steel. The composition of Test Specimen 12 was prepared by reducing manganese (Mn) from the powdery composition of Test Specimen 11. The composition of Test Specimen 13 was prepared by further reducing manganese (Mn) from the powdery composition of Test Specimen 11.

Next, a test specimen was cut from each of the composite materials obtained by the aforementioned method, and the micro-Vickers hardness of a metal constituting the porous metal sintered body was measured about each test specimen. Further, a seizure test specimen was produced from each of the composite materials, and a seizure test was applied to each test specimen in the same way as above by using an equivalent of JIS-SUJ2 as a mating member.

Table 4 shows the composition of each powder employed, hardness of each porous metal sintered body (an average of five points under a load of 300 g), and seizure test results.

As appreciated from Table 4, in respect of SKD11 modifications (Test Specimens 1 to 3), in the case where chromium (Cr) was contained in a relatively large amount, when the chromium (Cr) content was not less than 2 wt. % and the carbon (C) content was not less than 0.1 wt. %, the micro-Vickers hardness of the porous metal sintered body was not less than 200 and no seizure (no surface roughening) was observed in the seizure test.

In respect of SKD61 modifications (Test Specimens 4 to 8) and SKH modifications, in order to set the micro-Vickers hardness of the porous metal sintered body at not less than 200, it was necessary that the chromium (Cr) content is not less than 1.7 wt. %, that the carbon (C) content is not less than 0.1 wt.%, and that the content of at least one element of molybdenum (Mo), vanadium (V), tungsten (W), cobalt (Co), and manganese (Mn) is not less than 0.3 wt. %. In respect of Fe—Mn steel modifications, for the same purpose, it was necessary that the carbon (C) content is not less than 0.1 wt. % and that the manganese (Mn) content is not less than 10 wt. %.

TABLE 4

| TEST SPECIMEN | COMPOSITION (WT %) | HARDNESS (mHv) OF METAL CONSTITUTING POROUS SINTERED BODY | SEIZURE TEST RESULT |
|---|---|---|---|
| 1 | Fe-0.5C-12Cr(Si, Mn, Mo, V were removed and C was reduced from an equivalent of SKD 1 | 437 | ○ |
| 2 | Fe-0.1C-4Cr(C, Cr were reduced from 1) | 232 | ○ |
| 3 | Fe-0.1C-2Cr(Cr was reduced from 2) | 200 | ○ |
| 4 | Fe-0.1C-1.7Cr-1.3Mo-1V(Si, Mn were removed and C, Cr were reduced from an equivalent of SKD 61) | 251 | ○ |
| 5 | Fe-0.1C-1.7Cr-0.3Mo(Mo was reduced and V was removed from 4) | 205 | ○ |
| 6 | Fe-0.1C-1.7Cr-0.3V(V was removed and Mo was reduced from 4) | 211 | ○ |
| 7 | Fe-0.1C-1.7Cr-0.3W(Mo, V were removed and W was added to 4) | 223 | ○ |
| 8 | Fe-0.1C-1.7Cr-0.3Co(Mo, V were removed and Co was added to 4) | 203 | ○ |
| 9 | Fe-0.1C-1.7Cr-0.3Mn(C, Cr, Mn were reduced and Fe was removed from an equivalent of SKD61) | 210 | ○ |
| 10 | Fe-0.1C-1Cr-(Co was reduced from 8) | 175 | X |
| 11 | Fe-0.1C-18Mn(C was reduced from Fe—Mn STEEL) | 221 | ○ |
| 12 | Fe-0.1C-12Mn(Mn was reduced from 11) | 205 | ○ |
| 13 | Fe-0.1C-8Mn(Mn was reduced from 11) | 193 | X |

Figure 10:
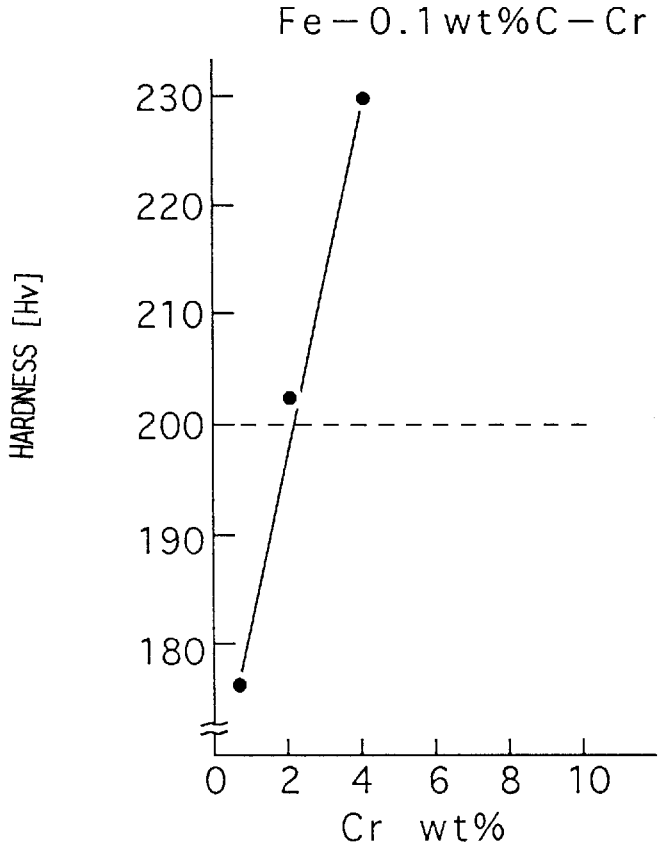
FIG. 10 is a graph showing a relation between the Cr content, and hardness of the porous metal sintered body, when Fe-0.1 wt. %-Cr alloys are used.
Figure 11:
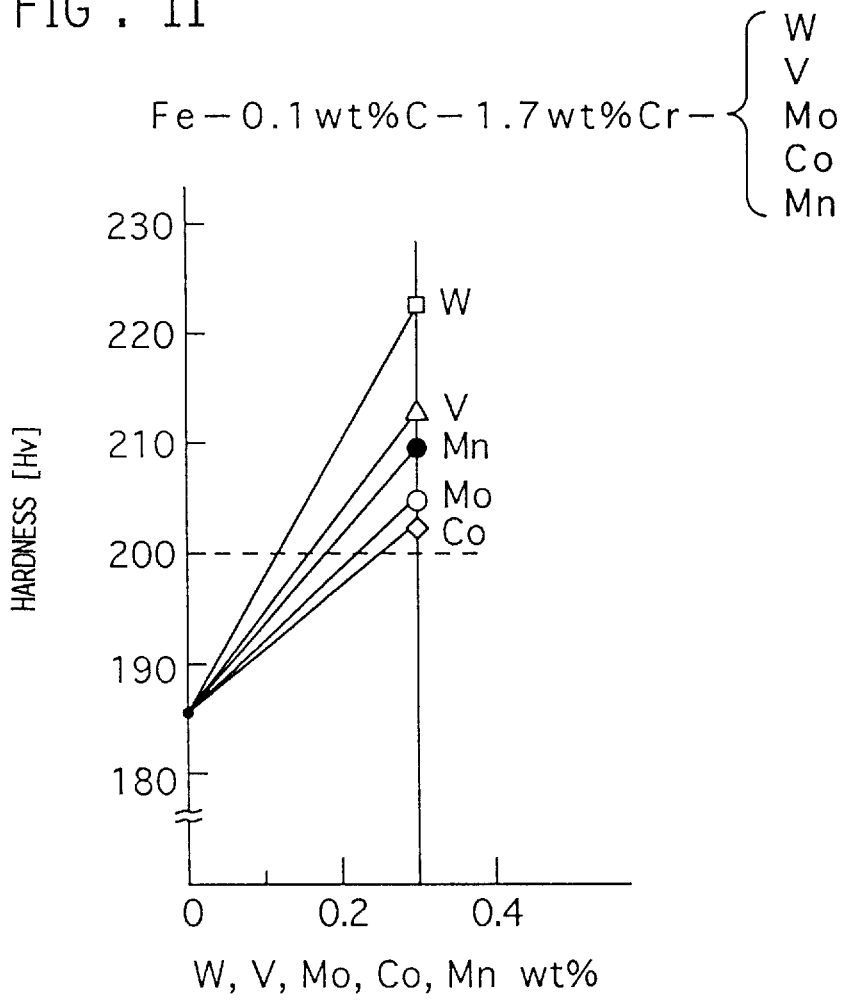
FIG. 11 is a graph showing a relation between each content of W, V, Mo, Co, and Mn, and hardness of the porous metal sintered body, when Fe-0.1 wt. %-1.7 wt. % Cr alloys are used.
Figure 12:
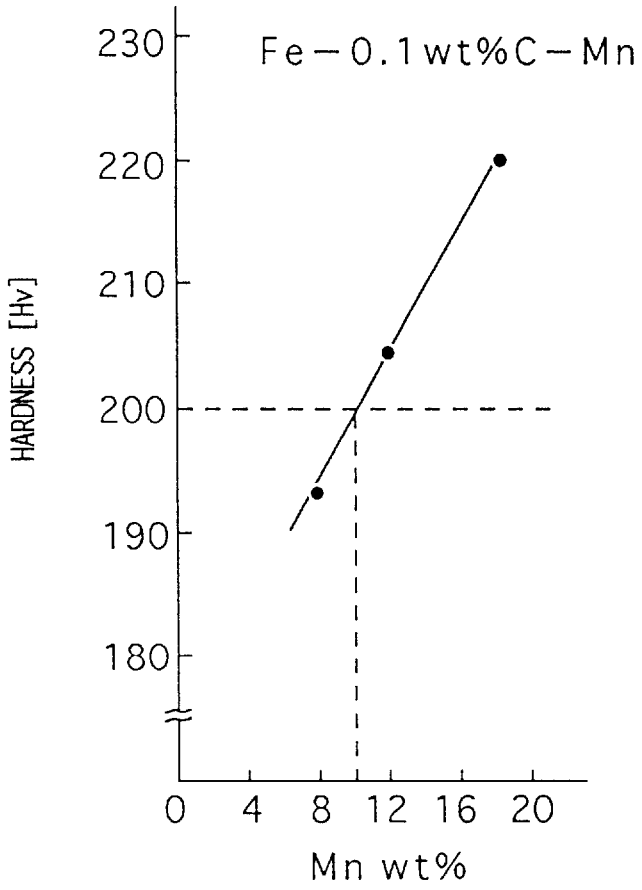
FIG. 12 is a graph showing a relation between the Mn content and hardness of the porous metal sintered body, when Fe-0.1 wt. % C-Mn alloys are used.

FIGS. 10 and 11 show test results in the case where the carbon content was as low as 0.1 wt. %. FIG. 10 is a graph showing a relation between the chromium (Cr) content and the micro-Vickers hardness of the metal constituting the porous metal sintered body, in the case where Fe-0.1 wt. % C—Cr alloys were employed as raw material powders of the porous metal sintered body. FIG. 11 is a graph showing a relation between separately varied content of tungsten (W), vanadium (V), molybdenum (Mo), cobalt (Co), and manganese (Mn) and the micro-Vickers hardness of the metal constituting the porous metal sintered body, in the case where Fe-0.1 wt. % C-1.7 wt. % Cr alloys were employed as raw material powder of the porous metal sintered body. FIG. 12 is a graph showing a relation between the Mn content and the micro-Vickers hardness of the metal constituting the porous metal sintered body, in the case where Fe-0.1 wt. % C-Mn alloys were employed as raw material powder of the porous metal sintered body.

As shown by the characteristic curve in FIG. 10, in the case where the C content was as low as 0.1 wt. %, the Cr content of up to 1 wt. % did not exhibit a remarkable increase in the hardness, but the Cr content of about 2 wt. % attained a micro-Vickers hardness of 200.

As shown by the characteristic curves in FIG. 11, in the case where Fe-0.1 wt. % C-1.7 wt. % Cr alloys were used, the W content of 0.3 wt. % attained a micro-Vickers hardness of more than 220, the V content of 0.3 wt. % attained a micro-Vickers hardness of more than 210, the Mo content of 0.3 wt. % attained a micro-Vickers hardness of more than 200, the Co content of 0.3 wt. % attained a micro-Vickers hardness of more than 200, and the Mn content of 0.3 wt. % attained a micro-Vickers hardness of more than 200. It must be noted that Co attributes to an improvement in hot strength.

As seen from the characteristic curve in FIG. 12, as the Mn content increased, the hardness sharply increased. When Fe-0.1 wt. % C-Mn alloys were used, the Mn content of about 10 wt. % achieved a micro-Vickers hardness of 200.

Preferred Embodiment 3

An effect of an amount of the hard material contained in a porous metal sintered body was evaluated by the following test.

Powder a (an equivalent of SKD61) in Table 1 and Powder o (FeCrC) in Table 1 was mixed and sintered to obtain a porous metal sintered body having the volume percentage of 70%. At this time, an amount of FeCrC was changed. In accordance with this change, an amount of a metal constituting the porous metal sintered body (Powder a) was regulated. As a result, the volume percentage of the porous metal sintered body was set at 70%.

After that, the afore-mentioned LFW abrasion test was applied under the same conditions. The result was shown in FIG. 13. The horizontal axis of FIG. 13 shows the mixing ratio of the hard material (FeCrC), based on the total volume of the composite material, and the vertical axis of FIG. 13 shows the abrasion amount in the specimen.

Figure 13:
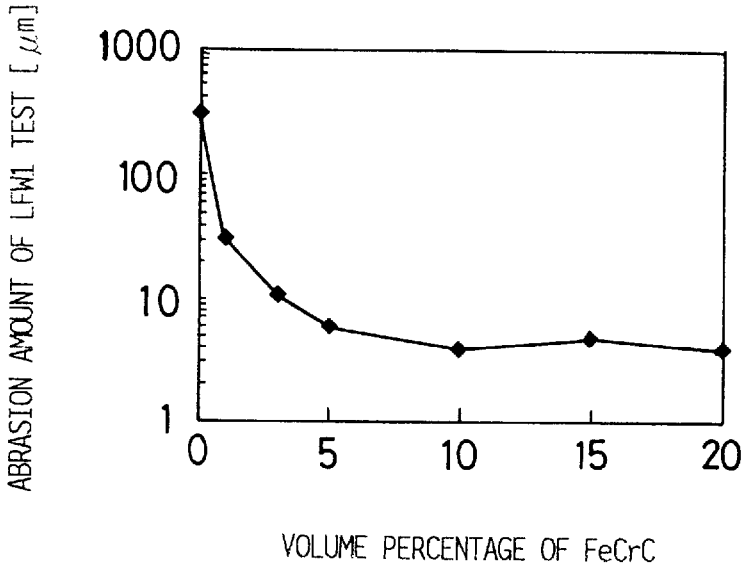
FIG. 13 is a graph showing a relation between an abrasion amount of LFW1 test and a volume percentage of FeCrC.

According to FIG. 13, an addition of a small amount of the hard material was found to be effective. When the hard material was added in an amount of not less than 5%, no remarkable effect was obtained. So, an additional amount of the hard material had no upper limit in respect of an abrasion resistance. However, when an additional amount of the hard material was too much, it lowered the machinability. Therefore, the upper limit of the mixing ratio of the hard material is set at not more than 35%, preferably, not more than 20% by volume, based on the total volume of the composite material. Or, the upper limit of the mixing ratio of the hard material is set at not more than 50%, preferably, not more than 30% by volume, based on the total volume of the porous metal sintered body.

As above described, an addition of a small amount of the hard material is effective. So, it is unnecessary to especially determine the lower limit of the mixing ratio of the hard material. However, in order to clearly obtain an effect of an addition of the hard material, the lower limit of the mixing ratio of the hard material is set at not less than 0.5%, preferably, 1.0% by volume, based on the total volume of the composite material. Or, the lower limit of the mixing ratio of the hard material is set at not less than 1%, preferably, 3% by volume, based on the total volume of the porous metal sintered body.

Obviously, many modifications and variations of the present inventions are possible in the light of the above teachings. It is therefore to be understood that within the scope of the appended claims, the invention may be practiced otherwise than as specifically described.

What is claimed is:

1. A metal sintered body composite material comprising:

a porous iron base metal sintered body having a space lattice structure having pores; and a light metal which has impregnated into said pores of said porous metal sintered body and has been solidified, wherein a micro-Vickers hardness of a metal constituting said porous metal sintered body is set at 200 to 800.

2. The metal sintered body composite material according to claim 1, wherein said micro-Vickers hardness of said metal constituting said porous metal sintered body is set at 230 to 430.

3. The metal sintered body composite material according to claim 1, wherein said light metal is one material selected from the group consisting of an aluminum alloy and a magnesium alloy.

4. The metal sintered body composite material according to claim 1, wherein said porous metal sintered body has a volume percentage of 30 to 88.

5. The metal sintered body composite material according to claim 3, wherein the composition of said aluminum alloy includes 0.8 to 1.3% by weight of copper (Cu), 11 to 13% by weight of silicon (Si), 0.7 to 1.3% by weight of magnesium (Mg), inevitable impurities, and the balance substantially of aluminum (Al).

6. The metal sintered body composite material according to claim 1, wherein the composition of said porous metal sintered body includes from 2 to 70% by weight of one element selected from the group consisting of chromium (Cr), molybdenum (Mo), vanadium (V), tungsten (W), manganese (Mn), and silicon (Si), from 0.07 to 8.2% by weight of carbon (C), inevitable impurities, and the balance substantially of iron (Fe), based on the total weight of said porous metal sintered body.

7. The metal sintered body composite material according to claim 1, wherein the composition of said porous metal sintered body includes from 0.5 to 1.2% by weight of carbon (C), from 5.8 to 8.7% by weight of chromium (Cr), from 0.1 to 0.6% by weight of molybdenum (Mo), from 0.1 to 0.6% by weight of vanadium (V), inevitable impurities, and the balance substantially of iron (Fe), based on the total weight of said porous metal sintered body.

8. The metal sintered body composite material according to claim 1, wherein said porous metal sintered body has one of a quenched phase formed by gas quenching treatment, and a tempered phase formed by tempering after said gas quenching treatment.

9. The metal sintered body composite material according to claim 1, wherein said porous metal sintered body comprises a metal constituting said porous metal sintered body and a hard material having a micro-Vickers hardness of not more than 2000.

10. The metal sintered body composite material according to claim 9, wherein said hard material contained in said porous metal sintered body is at least one material selected from the group consisting of chromium carbide, molybdenum carbide, vanadium carbide, and mullite.

11. The metal sintered body composite material according to claim 9, wherein said hard material contained in said porous metal sintered body is one material selected from the group consisting of Fe—Cr particles, Fe—Mo particles, and Fe—Cr—C particles.

12. The metal sintered body composite material according to claim 9, wherein said hard material is contained in an amount of not more than 50% by volume, based on the total volume of said porous metal sintered body, or in an amount of not more than 35% by volume, based on the total volume of said composite material.

13. The metal sintered body composite material according to claim 9, wherein said hard material has a particle diameter of 1 to 300 microns.

14. The metal sintered body composite material according to claim 9, wherein said porous metal sintered body includes one of a quenched phase and a tempered phase in which carbide having a smaller diameter than that of said hard material is generated.

15. The metal sintered body composite material according to claim 1, wherein said micro-Vickers hardness of said composite material is in the range from 240 to 360 under a load of 10 kgf.

16. A method of producing a metal sintered body composite material, using iron base raw material powder of a composition comprising 2 to 70% by weight of at least one element selected from the group consisting of chromium (Cr), molybdenum (Mo), vanadium (V), tungsten (W), manganese (Mn), and silicon (Si), 0.07 to 8.2% by weight of carbon, inevitable impurities, and the balance substantially of iron (Fe), and comprising the steps of:

sintering a powder molding formed of said iron base raw material powder so as to obtain a porous iron base metal sintered body of a composition which is capable of being gas quenched, and which has a space lattice structure having pores and a volume percentage of 30 to 88, gas quenching said porous metal sintered body by cooling said porous metal sintered body in gas, impregnating said pores of said porous metal sintered body with a molten light metal and solidifying said molten light metal so as to obtain a composite material, and heating said composite material into an aging temperature range of said light metal constituting said composite material so as to apply aging treatment to said light metal, whereby micro-Vickers hardness of a metal constituting said porous metal sintered body is set at 200 to 800.

17. The method of producing a metal sintered body composite material according to claim 16, wherein the composition of said porous metal sintered body comprises 0.5 to 1.2% by weight of carbon (C), 5.8 to 8.7% by weight of chromium (Cr), 0.1 to 0.6% of molybdenum (Mo), 0.1 to 0.6% by weight of vanadium (V), inevitable impurities, and the balance substantially of iron (Fe), based on the total weight of said porous metal sintered body.

18. The method of producing a metal sintered body composite material according to claim 16, wherein said porous metal sintered body is cooled at a cooling speed of 20° C./minute or more in said gas quenching step.

19. The method of producing a metal sintered body composite material according to claim 16, wherein said gas quenching step is performed in a non-oxidation atmosphere formed of at least one gas selected from the group consisting of nitrogen gas, hydrogen gas, and ammonia decomposition gas.

20. The method of producing a metal sintered body composite material according to claim 16, wherein said molten light metal is an aluminum alloy.

21. The method of producing a metal sintered body composite material according to claim 16, wherein said gas quenching step forms a quenched phase on said porous metal sintered body, and said quenched phase is stabilized by heat of said molten light metal in said impregnating step or the heating in said aging treatment step.

22. A method of producing a metal sintered body composite material according to claim 16, wherein said hard material is contained in an amount of not more than 50% by volume, based on the total volume of of said porous metal sintered body, or in an amount of not more than 35% by volume, based on the total volume of said composite material.

23. A method of producing a metal sintered body composite material according to claim 16, wherein sintering temperature of said powder molding is in the range from 1000° to 1200° C.

24. A method of producing a metal sintered body composite material according to claim 16, wherein said aging treatment is performed by heating and holding said composite material at 200° to 300° C.

25. A method of producing a metal sintered body composite material according to claim 16, wherein solution heat treatment is applied to said composite material by heating said composite material to a solution heat temperature range, before said aging treatment step.

26. A method of producing a metal sintered body composite material according to claim 16, wherein a powder molding is obtained by using a mixed powder mixing powder of iron raw material and powder of said hard material.

* * * * *